United States Patent [19]

Christini et al.

[11] Patent Number: 5,071,523

[45] Date of Patent: Dec. 10, 1991

[54] TWO STAGE LITHIUM TRANSPORT PROCESS

[75] Inventors: Roy A. Christini, Washington Township, Armstrong County; Robert K. Dawless, Monroeville, both of Pa.

[73] Assignee: Aluminum Company of America, Pittsburgh, Pa.

[21] Appl. No.: 421,017

[22] Filed: Oct. 13, 1989

[51] Int. Cl.[5] ..... C25C 3/02; C25C 3/06

[52] U.S. Cl. ..... 204/67; 204/68; 204/71; 204/140; 75/681

[58] Field of Search ..... 204/71, 68, 67, 70, 204/140, 244; 75/681

[56] References Cited

U.S. PATENT DOCUMENTS

| | | | |
|---|---|---|---|
| 1,534,315 | 4/1925 | Hoopes | 204/67 X |
| 1,534,316 | 4/1925 | Hoopes et al. | 204/67 |
| 1,534,317 | 4/1925 | Hoopes et al. | 204/67 |
| 1,534,318 | 4/1925 | Hoopes | 204/67 |
| 1,534,319 | 4/1925 | Hoopes et al. | 204/67 |
| 1,534,320 | 4/1925 | Hoopes | 204/67 |
| 1,534,321 | 4/1925 | Hoopes | 204/67 |
| 1,534,322 | 4/1925 | Hoopes | 204/67 |
| 1,535,458 | 4/1925 | Frary | 204/67 |
| 1,562,090 | 11/1925 | Hoopes | 204/245 |
| 3,904,494 | 9/1975 | Jacobs et al. | 204/67 |
| 3,962,064 | 6/1976 | Brut et al. | 204/245 |
| 4,156,635 | 5/1979 | Cooper et al. | 204/68 |
| 4,183,745 | 1/1980 | Tsumura | 75/68 R |
| 4,209,496 | 6/1980 | Carpenter et al. | 423/210 |
| 4,222,830 | 9/1980 | Dawless et al. | 204/67 |
| 4,239,606 | 12/1980 | Dawless et al. | 204/67 |
| 4,248,630 | 2/1981 | Balmuth | 75/135 |
| 4,273,627 | 6/1981 | Dawless et al. | 204/67 |
| 4,385,964 | 5/1983 | Johnson et al. | 203/50 |
| 4,390,364 | 6/1983 | Yu | 75/67 A |
| 4,411,747 | 10/1983 | Dawless et al. | 204/67 |
| 4,430,174 | 2/1984 | Tsumura | 204/67 |
| 4,436,627 | 3/1984 | McMonigle | 210/695 |
| 4,440,610 | 4/1984 | Dawless et al. | 204/67 |
| 4,455,202 | 6/1984 | Sintim-Damoa et al. | 204/68 |
| 4,456,479 | 6/1984 | Harris et al. | 75/63 |
| 4,758,316 | 7/1988 | Stewart, Jr. et al. | 204/67 |
| 4,780,186 | 10/1988 | Christini et al. | 204/68 |
| 4,790,917 | 12/1988 | Dewing | 204/140 |
| 4,849,072 | 7/1989 | Bowman | 204/68 |
| 4,882,017 | 11/1989 | Weaver | 224/244 X |

FOREIGN PATENT DOCUMENTS

| | | |
|---|---|---|
| 267054 | 11/1988 | European Pat. Off. . |
| 2933065 | 1/1981 | Fed. Rep. of Germany . |
| 54-043811 | 4/1979 | Japan . |

OTHER PUBLICATIONS

Junius David Edwards et al, "The Aluminum Industry, Aluminum and Its Production," McGraw-Hill Book Company, Inc., New York, 1930, pp. 322-327.

Basant L. Tiwari et al, "Electrolytic Extraction of Magnesium from Commercial Aluminum Alloy Scrap," *Physical Chemistry of Extractive Metallurgy*, AIME, New York, Feb. 1985, pp. 147-164.

Basant L. Tiwari, "Demagging Processes for Aluminum Alloy Scrap," *Journal of Metals*, Jul. 1982, pp. 54-58.

(List continued on next page.)

*Primary Examiner*—Donald R. Valentine

*Attorney, Agent, or Firm*—Douglas G. Glantz

[57] ABSTRACT

The present invention provides a process for purifying aluminum and lithium including recovering aluminum and lithium through layered electrolysis through a lithium transport cell to form purified lithium metal and residual aluminum and purifying the residual aluminum through a second stage layered electrolysis through a second stage lithium transport cell to form purified aluminum metal. In one aspect, the process provides the second stage step for purifying the residual aluminum by chlorinating the residual aluminum to form a purified aluminum.

In one aspect, layered electrolysis is provided by a three-layered electrolysis cell including an end layer of molten aluminum-lithium alloy, a middle layer of molten salt electrolyte, and an opposite end layer of molten lithium.

22 Claims, 1 Drawing Sheet

OTHER PUBLICATIONS

M. Schofield, "Development in Lithium Technology," *Metallurgia,* Dec. 1964, pp. 278–280.

Joseph S. Smatko, "The Lithium Electrolytic Cell," Published by the Office of Military Government for Germany, Apr. 1, 1946.

R. R. Rogers et al, "The Production of Lithium Metal," *The Canadian Mining and Metallurgical Bulletin,* Nov. 1948, pp. 623–628.

Richard Bauer, "Lithium—Electrochemical Aspects," Chemi-Ing. Techn., 44, (4), 1972, pp. 147–151.

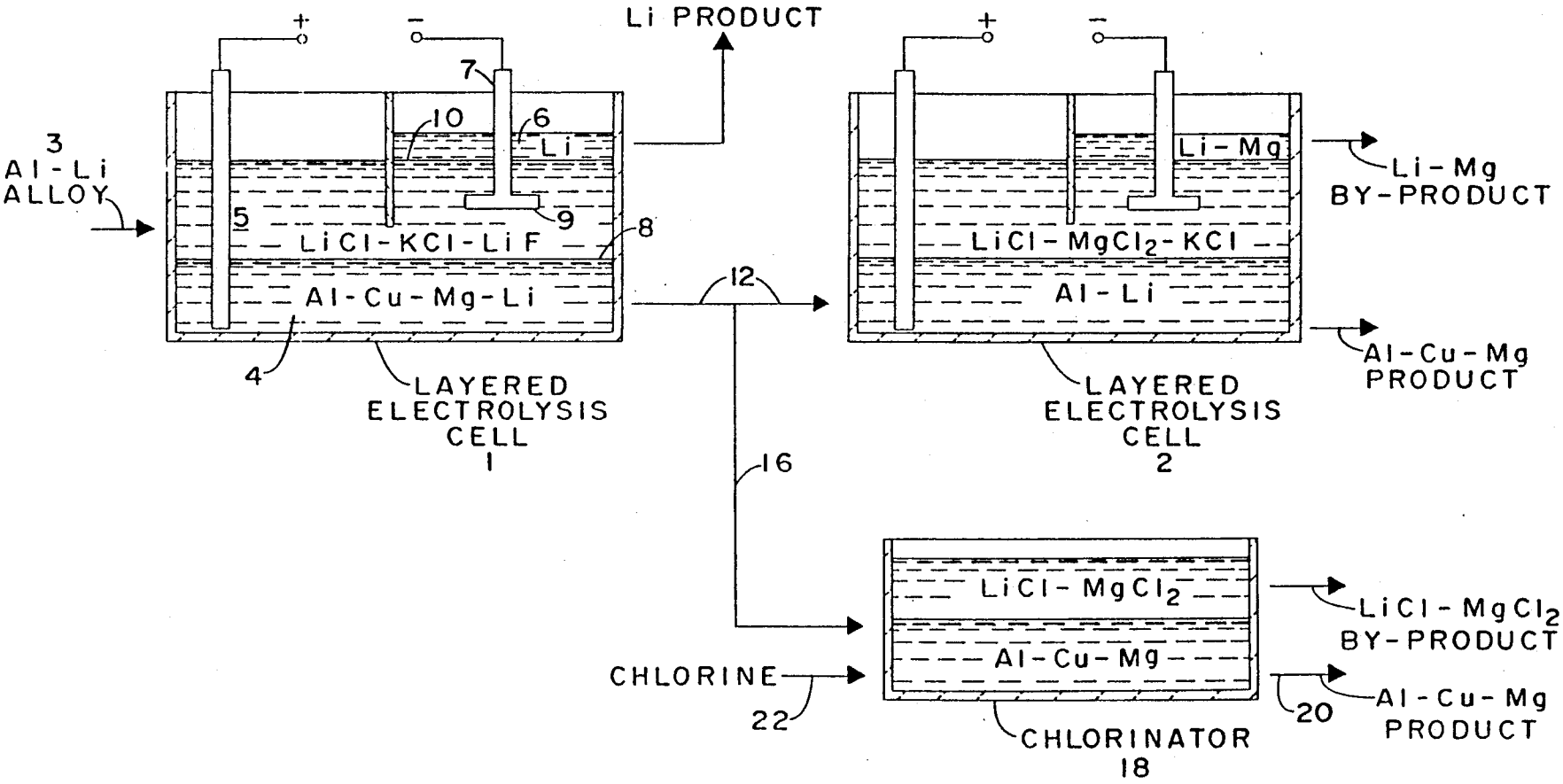
Li-Mg BY-PRODUCT
Al-Cu-Mg PRODUCT
LiCl-MgCl2 BY-PRODUCT
Al-Cu-Mg PRODUCT
20
Li-Mg
LiCl-MgCl2-KCl
Al-Li
LAYERED ELECTROLYSIS CELL 2
LiCl-MgCl2
Al-Cu-Mg
CHLORINATOR 18
Li PRODUCT
12
16
CHLORINE
22
8
Li
6
9
7
10
LiCl-KCl-LiF
Al-Cu-Mg-Li
LAYERED ELECTROLYSIS CELL 1
5
4
3 Al-Li ALLOY

TWO STAGE LITHIUM TRANSPORT PROCESS

BACKGROUND OF THE INVENTION

1. Technical Field

This invention relates to a process for producing purified lithium and purified aluminum from recycled lithium-containing alloys such as aluminum-lithium alloy scrap.

2. Background

Aluminum-lithium alloys offer advantages of lighter weight and high structural integrity. Because of the lighter weight and combination with high structural integrity, the aluminum-lithium alloys with higher amounts of lithium are attractive to the aerospace industry for use in aircraft structures to provide lighter weight in the aircraft. The lighter weight provides significant savings in fuel costs over the life of an aircraft. For these reasons, aluminum-lithium alloys currently are receiving more attention as candidates for use in structural metal applications in the aerospace industry The aircraft industry in producing structural applications of aluminum alloys generates large quantities of scrap. The scrap generated from aluminum fabrication can be recycled to produce the most economical processing in applications and products especially in aircraft plate and sheet or aircraft extrusions However, since several different alloys are used, mixed scrap may not be recyclable in whole or even in part by melting the scrap and forming the ingot directly. If scrap cannot be recycled into new aluminum-lithium ingot, some method must be found to remove and recover lithium from the scrap. Processes that lead to the production of both purified lithium and lithium-free aluminum are desirable.

The electrolytic processes conventionally available for recycling aluminum-lithium scrap have one or more drawbacks and disadvantages which have been found to be undesirable in the pursuit of reclaiming purified aluminum from aluminum-lithium alloy scrap.

It is an object of the present invention to provide a process for producing purified lithium from recycled aluminum-lithium alloy scrap.

It is a further object of the present invention to provide a process for producing purified aluminum from recycled aluminum-lithium alloy scrap.

It is yet another object of the present invention to provide a process for producing purified aluminum from residual aluminum alloy withdrawn from a three-layered lithium transport cell.

These and other objects of the present invention will become apparent from the detailed description of the invention as follows.

SUMMARY OF THE INVENTION

The present invention provides a process for purifying aluminum and lithium including recovering aluminum and lithium through layered electrolysis through a lithium transport cell to form purified lithium metal and residual aluminum and purifying the residual aluminum through a second stage layered electrolysis through a second stage lithium transport cell to form purified aluminum metal. In one aspect, the process provides the second stage step for purifying the residual aluminum by chlorinating the residual aluminum to form a purified aluminum.

In one aspect, layered electrolysis is provided by a three-layered electrolysis cell including an end layer of molten aluminum-lithium alloy, a middle layer of molten salt electrolyte, and an opposite end layer of molten lithium.

BRIEF DESCRIPTION OF THE DRAWING

The sole FIGURE shows a schematic diagram of the process of the present invention.

DETAILED DESCRIPTION

We have found empirically that a single stage three-layered electrolysis transport cell for purifying lithium from aluminum-lithium scrap cannot produce both a purified lithium and a purified aluminum. Referring to the sole FIGURE, aluminum-lithium scrap, having a composition of about 2.5 wt % lithium, 1 wt % magnesium, and 1 wt % copper is fed to a layered electrolysis cell 1 in feed stream 3. The alloy is not intended to be limited to these specific ranges and, especially, is not intended to exclude higher lithium content. The aluminum-copper-magnesium-lithium molten alloy 4 is made the anode, and a submerged metal plate is extended as part of cathode 7 submerged into the molten salt bath 5. DC current is applied. Lithium is oxidized at the lower aluminum-lithium/molten salt bath interface 8. Lithium is simultaneously reduced at the bath/cathode plate interface 9 and forms as floating lithium pool 6. The molten salt bath 5 is composed of lithium chloride-potassium chloride-lithium fluoride. The critical parameters of cell 1 are (1) lithium removal control and (2) current density at the anode interface.

If lithium is removed from the aluminum-lithium to levels below about 0.3–0.5 wt % lithium, then magnesium is oxidized into the bath. The magnesium oxidizing into the bath will be followed very shortly by magnesium reduction at the cathode resulting in an impure lithium. Anodic current density can be above four (4) amps per square inch to about ten (10) to twenty (20) amps per square inch, but preferably is controlled to be less than about four (4) amps per square inch for a quiescent system. Above about four (4) amps per square inch (anodic), magnesium and aluminum can be oxidized at the anode and are reduced at the cathode, again producing an impure lithium. Cathodic current density was much higher between twenty (20) to seventy (70) amps per square inch. The anode surface was somewhat oversized.

The layered electrolysis cell process in a single stage does not permit the production of pure aluminum (or pure aluminum-copper on aluminum-copper-magnesium). The cell described heretofore does not permit the production of pure aluminum containing 0 wt % lithium. We have found that any attempt to reduce the lithium content below about 0.3–0.5 wt % lithium results in an impure lithium product.

The process of the present invention is designed to overcome the drawbacks of a single cell layered electrolysis process for recycling aluminum-lithium. The process of the present invention proposes a staged process to produce both pure lithium and pure aluminum. A second stage layered electrolysis cell, as shown at 2 in the sole FIGURE, provides a second electrolysis cell such that aluminum-copper-magnesium alloy containing residual lithium is withdrawn from cell 1 and passed in line 12 to cell 2. In cell 2, electrolysis is continued but with no attempt to limit the magnesium transport. Cell 2 is controlled to remove all lithium from the alloy. Electrolysis continues until the aluminum alloy contains less than about 0.001 wt % lithium. The top (cathode) product is an alloy of lithium-magnesium or lithium-magnesium-aluminum. The major or important product of this cell is an aluminum-copper alloy with no lithium content which can be recycled into 2XXX Series alloys or into aluminum-lithium alloys.

Alternatively, a second stage step can be provided by a unit process of passing the aluminum-copper alloy withdrawn from cell 1 at line 12 and directing the withdrawn alloy in line 16 to chlorinator 18. The aluminum-copper-magnesium alloy containing residual lithium would be tapped into the chlorinator 18 at product stream 16. Chlorine would be added in line 22 to reduce the lithium to less than about 0.001 wt % lithium producing lithium chloride. Some of the magnesium and aluminum can be chlorinated to produce a lithium chloride-magnesium chloride-aluminum chloride salt. The main product of the chlorinator is an aluminum-copper alloy 20 substantially free from lithium.

Several advantages are provided by the two staged process of the present invention. Most of the lithium, i.e., such as about 80 wt %, can be recovered as purified lithium in cell 1. Most of the aluminum-copper alloy, i.e., such as about greater than about 90 wt %, can be recovered from a second staged layered electrolysis cell. A minimal amount of the original lithium, i.e., such as less than about 20 wt %, is recovered in a form with the value either of lithium-magnesium or lithium chloride-magnesium chloride-aluminum chloride.

Reference is made to Christini et al U.S. Pat. No. 4,780,186 for "Lithium Transport Cell Process." The prior Christini et al patent provides a detailed description of the lithium transport cell process including a process for recovering lithium from an aluminum-lithium alloy scrap in a layered electrolysis cell, including using a three-layered electrolytic cell having a specified bath composition of lithium chloride, or lithium chloride and potassium chloride, or lithium chloride, potassium chloride, and lithium fluoride. The description of the three-layered electrolysis process appearing in Christini et al U.S. Pat. No. 4,780,186 applies to the process of the present invention and is hereby incorporated by reference to this detailed description of the present invention.

Another patent application made by Christini et-al U.S. Ser. No. 217,764, filed July 11, 1988, now U.S. Pat. No. 4,973,390, describes certain preferred embodiments of the apparatus used in producing lithium from aluminum-lithium alloy scrap in a three-layered lithium transport cell. The disclosure contained in U.S. Ser. No. 217,764 is pertinent to the process of the present invention and is hereby incorporated by reference.

EXAMPLE 1

We have found that operation of a single stage layered electrolysis lithium transport cell provided a lithium product of purity which decreased (as percent magnesium increased) when lithium was reduced below about 0.14 wt %. The magnesium drop in aluminum-lithium from about 1.11 wt % to about 0.70 wt % is shown between the last two samples shown in Table 1.

TABLE 1

Single Cell Operation
Bath - 95 wt % LiCl; 0 wt % KCl; 5 wt % LiF
Anode Current Density = 4.19 amps/in$^2$

| Al—Li Analyses | | |
|---|---|---|
| Sample No. | wt % Li | wt % Mg |
| 0M | 1.91 | 1.23 |
| — | — | — |
| 4M | 0.43 | 1.10 |
| 5M | 0.14 | 1.11 |
| 6M | 0.01 | 0.70 |
| **Li Metal Analyses** | | |
| Sample No. | wt % Al | wt % Mg |
| — | — | — |
| 1L | 0.54 | 0.64 |
| 4L | 0.12 | 0.51 |
| 5L | 0.01 | 0.56 |
| 6L | 0.00 | 1.49 |

The magnesium is believed to have acted as a buffer in the system, and the lithium breakthrough point is driven to a slightly lower value. The percent lithium in aluminum-lithium at breakthrough was less than 0.2 wt % and was found to be provided at less than about or equal to 0.14 wt %.

EXAMPLE 2

A single lithium transport cell for layered electrolysis of aluminum-lithium alloy scrap was operated and the results are shown in Table 2.

TABLE 2

Single Cell Operation
Bath - 45 wt % LiCl; 50 wt % KCl; 5 wt % LiF
Anode Current Density = 3.57 amps/in$^2$

| Al—Li Analyses | | |
|---|---|---|
| Sample No. | wt % Li | wt % Mg |
| 0M | 1.88 | 1.20 |
| — | — | — |
| 4M | 0.6 | 1.1 |
| 5M | (0.34)* | (1.0)* |
| 6M | 0.07 | 0.9 |
| **Li Metal Analyses** | | |
| Sample No. | wt % Al | wt % Mg |
| — | — | — |
| 1L | 0.00 | 0.49 |
| 4L | 0.00 | 0.64 |
| 5L | 0.00 | 0.23 |
| 6L | 0.45 | 0.87 |

*estimated

The lithium product purity was found to decrease because of a sudden increase in the percent aluminum from about 0.002 to about 0.45 wt %. The decrease in lithium product purity and increase in aluminum corresponds to the same period in which the percent lithium in the aluminum-lithium drops from about 0.34 wt % to about 0.07 wt % lithium. The percent magnesium in aluminum-lithium is also changing, i.e., from 1.1 wt % in 4M to 0.9 wt % in 6M. However, Sample 5M was not taken so it cannot be determined whether the change was gradual or abrupt.

EXAMPLE 3

A higher current density was applied to the operation of a single stage cell layered electrolysis, and the results are shown in Table 3.

TABLE 3

| Single Cell Operation<br>Bath - 70 wt % LiCl; 25 wt % KCl; 5 wt % LiF<br>Anode Current Density = 8.21 amps/in$^2$<br>(Note that Anode Current Density ≈ twice as big) | | |
|---|---|---|
| | Al—Li Analyses | |
| Sample No. | wt % Li | wt % Mg |
| 0M | 0.98 | 0.76 |
| 1M | 0.55 | 0.69 |
| 2M | 0.36 | 0.63 |
| 3M | 0.19 | 0.55 |
| 4M | 0.09 | 0.45 |
| | Li Metal Analyses | |
| Sample No. | wt % Al | wt % Mg |
| — | — | — |
| 1L | 0.01 | 1.44 |
| 2L | 0.03 | 2.25 |
| 3L | 0.37 | 2.84 |
| 4L | 3.96 | 6.59 |

At the higher current density, there was less discriminating power, and the transport of magnesium started to occur right at the beginning of the run instead of after the lithium depletion. However, at lithium breakthrough, percent lithium in aluminum-lithium drops below about 0.19 wt %, before the percent magnesium in the lithium, (2.84 wt % to 6.59 wt %) and percent in the lithium (0.37 wt % to 3.96 wt %) increased dramatically.

EXAMPLE 4

In accordance with the process of the present invention, a two staged layered electrolysis was provided and a second lithium transport cell was applied to the alloy tapped from the single stage layered electrolysis lithium transport cell, and the results are shown in Table 4.

TABLE 4

| Cell Two Operation in Staged Process<br>Bath - 70 wt % LiCl; 25 wt % KCl; 5 wt % LiF<br>Anode Current Density = 6.3 amps/in$^2$ | | | | |
|---|---|---|---|---|
| | Al—Li Analyses | | | |
| Sample No. | wt % Li | wt % Mg | wt % Na | wt % Ca |
| −1M | 0.14 | 0.9 | 0.0001 | 0.007 |
| −6M | 0.000 | 0.00 | 0.0000 | 0.0000 |

| | Li Metal Analyses | | | | |
|---|---|---|---|---|---|
| Sample No. | wt % Li | wt % Mg | wt % Na | wt % Ca | wt % Al |
| −1L | 98.8 | 0.10 | 0.4 | 0.5 | 0.20 |
| −6L | 64.7 | 9.6 | 0.3 | 0.5 | 24.9 |

The 1M and 1L Samples correspond to the aluminum-lithium and lithium metal produced at the end of the single stage cell operation. The 1M metal would be the aluminum-lithium feed to the second stage lithium transport cell operation. By driving the electrolysis hard, all the lithium, magnesium, sodium, and calcium were removed from the aluminum, producing an aluminum-1.0 wt % copper alloy as shown in Sample 6M. The aluminum-copper alloy would be very desirable for certain applications considering the very low lithium, magnesium, sodium, and calcium content. The lithium product, on the other hand, is very impure, as shown in Sample 6L. The lithium product not only is high in magnesium and aluminum but also in sodium and in calcium. Impure lithium would have only a limited use and probably would be of low value. However, the lithium here was formed from the second stage operation, and the purified lithium from the aluminum-lithium scrap would come from the first stage cell in the staged cell operation.

EXAMPLE 5

Table 5 shows a run for the staged lithium transport cell operation in which the lithium sample shown in 2L already was contaminated heavily with magnesium and aluminum so no high quality lithium was produced. The aluminum-lithium shown in the 2M Sample was lower in lithium than a typical end point sample for a single cell operation. No aluminum-lithium samples were taken from 0.1–0.4 wt % lithium range. The 4M Sample had very low levels of lithium, magnesium, sodium, and calcium. Magnesium (in 4M) was not as low as in the run shown in Table 4 (Sample 6M) which also corresponded with the fact that the 4L lithium sample was purer than the 6L Sample in Table 4.

TABLE 5

| Cell Two Operation in Staged Process<br>Bath - 70 wt % LiCl; 25 wt % KCl; 5 wt % LiF<br>Anode Current Density = 4.2 amps/in$^2$ | | | | |
|---|---|---|---|---|
| | Al—Li Analyses | | | |
| Sample No. | wt % Li | wt % Mg | wt % Na | wt % Ca |
| −2M | 0.04 | 0.57 | 0.0000 | 0.0006 |
| −4M | 0.000 | 0.03 | 0.0000 | 0.0000 |

| | Li Metal Analyses | | | | |
|---|---|---|---|---|---|
| Sample No. | wt % Li | wt % Mg | wt % Na | wt % Ca | wt % Al |
| −2L | 95.5 | 1.3 | 0.3 | 0.1 | 2.8 |
| −4L | 96.1 | 1.3 | 0.3 | 0.4 | 1.9 |

EXAMPLE 6

Table 6 shows another operation of the cell 2 in the staged process, and Sample 4M corresponds roughly to the end of the first cell operation. The 4M aluminum-lithium metal was the feed to the second stage. No lithium metal Sample 4L was taken or analyzed to correspond to 4M. The 3L Sample had lithium metal already contaminated with aluminum. Referring back to Tables 4 and 5, when the lithium was driven low in the aluminum-lithium, e.g., such as Sample 7M, magnesium, sodium, and calcium also were low. The aluminum-copper alloy was a very desirable product.

TABLE 6

| Cell Two Operation in Staged Process<br>Bath - 70 wt % LiCl; 25 wt % KCl; 5 wt % LiF<br>Anode Current Density = 1.8 amps/in$^2$ | | | | |
|---|---|---|---|---|
| | Al—Li Analyses | | | |
| Sample No. | wt % Li | wt % Mg | wt % Na | wt % Ca |
| −3M | 0.61 | 1.01 | 0.0001 | 0.005 |
| −4M | 0.14 | 0.93 | 0.0001 | 0.002 |
| −7M | 0.000 | 0.00 | 0.0000 | 0.0000 |

| | Li Metal Analyses | | | | |
|---|---|---|---|---|---|
| Sample No. | wt % Li | wt % Mg | wt % Na | wt % Ca | wt % Al |
| −3L | ~91 | 0.6 | 0.1 | 0.2 | 8 |
| −7L | ~98 | 0.5 | 0.1 | 0.2 | 1 |

EXAMPLE 7

A chlorinator was provided for the staged process with the results that lithium was reduced to very low levels in aluminum-lithium metal. Results are shown in Table 7.

TABLE 7

Chlorinator - Step Two for Staged Process
Bath - 50 wt % LiCl; 50 wt % KCl; 440 g
Chlorine Flow Rate - 250 cc/min
Total Chlorine Added - 45 liters
Al-Li wt (initial) - 1000 g

| Al—Li Analyses | | | |
|---|---|---|---|
| Sample No. | wt % Li | wt % Mg | wt % Cu |
| 1 | 0.12 | 0.9 | 1.0 |
| 2 | 0.001 | 0.02 | 1.08 |

Chlorination Efficiency - 33%

The final product essentially was an aluminum-1.0 wt % copper alloy. The bath samples were contaminated with $Al_2O_3$ and no bath purity analyses were available. Light bath (not analyzed) was found in the crucible after settling and slow cooling, but subsequent runs showed the light bath to be a very high quality bath. The final liquid bath sample was taken before shutdown. No time was allowed for settling and thus part of the high $MgCl_2$ and $AlCl_3$ could be attributable to the suspended MgO and $Al_2O_3$. The final liquid bath sample was found to be 46.31 wt % lithium chloride, 33.18 wt % potassium chloride, 0.02 wt % sodium chloride, 0.06 wt % calcium chloride, 6.70 wt % magnesium chloride, and 12.11 wt % aluminum chloride.

EXAMPLE 8

Lithium in aluminum-lithium was lowered to very low levels in a final aluminum-lithium metal from 0.40 wt % to 0.006 wt % as shown in Table 8.

TABLE 8

Chlorinator - Step Two for Staged Process
Bath - 50 wt % LiCl; 50 wt % KCl; 1600 g
Chlorine Flow Rate - 125 cc/min
Total Chlorine Added - 22.5 liters
Al—Li wt (initial) - 2200 g

| Al—Li Analyses | | | |
|---|---|---|---|
| Sample No. | wt % Li | wt % Mg | wt % Cu |
| 1 | 0.40 | 0.30 | 0.20 |
| 2 | 0.08 | 0.26 | 0.21 |
| 3 | 0.006 | 0.22 | 0.22 |

| Final Bath | | | | | |
|---|---|---|---|---|---|
| wt % LiCl | wt % KCl | wt % NaCl | wt % $CaCl_2$ | wt % $MgCl_2$ | wt % $AlCl_3$ |
| 53.0 | 46.4 | <.02 | <.02 | <.02 | <.03 |

Chlorination Efficiency - 68%

Even at these low Li levels, the final bath composition was quite good with no detectable pickup of magnesium chloride or aluminum chloride in the final bath, i.e., less than about 0.02 wt % and less than about 0.03 wt % were minimum detection limits.

EXAMPLE 9

A final experiment for the chlorinator two step staged process was operated and the results are shown in Table 9.

TABLE 9

Chlorinator - Step Two for Staged Process
Bath - 100 wt % LiCl; 1600 g
Chlorine Flow Rate - 600 cc/min
Total Chlorine Added - 72 liters
Al—Li wt (initial) - 4400 g

| Al—Li Analyses | | | |
|---|---|---|---|
| Sample No. | wt % Li | wt % Mg | wt % Cu |
| 1 | 0.07 | 0.80 | 1.35 |

TABLE 9-continued

Chlorinator - Step Two for Staged Process
Bath - 100 wt % LiCl; 1600 g
Chlorine Flow Rate - 600 cc/min
Total Chlorine Added - 72 liters
Al—Li wt (initial) - 4400 g

| | | | |
|---|---|---|---|
| 2 | 0.00 | 0.00 | 1.34 |

| Final Bath | | | | | |
|---|---|---|---|---|---|
| wt % LiCl | wt % KCl | wt % NaCl | wt % $CaCl_2$ | wt % $MgCl_2$ | wt % $AlCl_3$ |
| 76.4 | .10 | .05 | .06 | 7.7 | 16.8 |

Chlorination Efficiency - 7.8%

An extreme case of about 12:1 ratio excess of chlorine was fed just to find if the lithium could be driven to zero. The final aluminum-1.3 wt % copper alloy had essentially no lithium or magnesium.

Because of the chlorine excess, large amounts of $AlCl_3$ and $MgCl_2$ were produced which led to an impure lithium chloride-magnesium chloride-aluminum chloride bath.

A single cell layered electrolysis was operated and the results are shown in Tables 1, 2, and 3. The single cell produced an aluminum-lithium product with about 0.2 wt % lithium. When the percent lithium was lowered below about 0.2 wt % lithium, other ions started to transport and resulted in an impure lithium product.

A staged layered electrolysis cell operation using two lithium transport cells in series was operated and the results are shown in Tables 4, 5, and 6. Results are shown for the second staged cell 2 where the aluminum-lithium was electrolyzed to remove all the lithium. In the data shown in Tables 4, 5, and 6, very low lithium was found in the purified aluminum product. A side benefit was found in that magnesium, sodium, and calcium also were removed to very low levels. The remaining aluminum-copper alloy can be used for special applications because of its very low level of these impurities. Another advantage was found in that recycling was very easy for this aluminum-copper alloy into 2XXX Series alloys.

A chlorinator used as the second stage operation in the staged process was operated and the results shown in Tables 7, 8, and 9. The chlorinator reduced lithium in the aluminum-lithium to very low levels with chlorine. In Tables 7 and 9, high levels of aluminum chloride and magnesium chloride in the bath were produced. In Table 8, the bath was quite pure.

The process of the present invention can be applied to lithium-containing alloys to purify lithium and other metals, other than aluminum, for metals more electronegative than lithium, i.e., for metals wherein the electromotive force required to oxidize said second metal is higher than the force required to oxidize lithium, e.g., such as magnesium.

While the invention has been described in terms of preferred embodiments, the claims appended hereto are intended to encompass all embodiments which fall within the spirit of the invention.

What is claimed is:

1. A process for purifying aluminum and lithium comprising:

(a) recovering aluminum and lithium from an aluminum-lithium alloy through layered electrolysis through a first stage lithium transport cell to form purified lithium metal and residual aluminum; and (b) purifying said residual aluminum through layered electrolysis through a second stage lithium transport cell to form purified aluminum metal.

2. A process as set forth in claim 1 wherein said layered electrolysis through a lithium transport cell comprises passing direct current through a three-layered cell having a first end layer of aluminum-lithium alloy, oxidizing lithium out of the alloy into a middle layer of molten salt electrolyte and reducing lithium ions in said molten salt electrolyte to form said purified lithium metal in a second end layer opposite said first end layer of the three-layered cell.

3. A process as set forth in claim 2 wherein said molten salt electrolyte comprises a lithium chloride-potassium chloride-lithium fluoride salt mixture.

4. A process as set forth in claim 3 wherein said layered electrolysis further comprises removing moisture from the aluminum-lithium alloy prior to said recovering aluminum and lithium from an aluminum-lithium alloy through said first stage lithium transport cell.

5. A process as set forth in claim 4 wherein said aluminum-lithium alloy consists essentially of about 2.5 wt % lithium, 1 wt % magnesium, and 1 wt % copper, balance aluminum.

6. A process as set forth in claim 5 wherein said layered electrolysis comprises controlling direct current density to less than about 4 amps per square inch.

7. A process as set forth in claim 6 wherein said purifying through layered electrolysis in the second stage of a lithium transport cell produced an aluminum metal product containing below about 0.3 wt % lithium.

8. A process as set forth in claim 7 wherein said second stage layered electrolysis is carried out to remove lithium from said aluminum-lithium alloy to form an aluminum product containing less than about 0.01 wt % lithium.

9. A process as set forth in claim 8 wherein said aluminum product contains less than about 0.001 wt % lithium.

10. A process for purifying aluminum and lithium comprising:

(a) recovering aluminum and lithium from an aluminum-lithium alloy through layered electrolysis through a lithium transport cell to form purified lithium metal and residual aluminum; and (b) purifying said residual aluminum by chlorinating said residual aluminum to form a purified aluminum.

11. A process as set forth in claim 10 wherein said aluminum-lithium alloy initially contains about 2.5 wt % lithium, 1 wt % magnesium, and 1 wt % copper.

12. A process as set forth in claim 11 wherein said purifying residual aluminum by chlorinating forms a purified aluminum containing below about 0.3 wt % lithium.

13. A process as set forth in claim 12 further comprising withdrawing aluminum-copper alloy and lithium-chloride from said chlorinating step.

14. A process as set forth in claim 13 wherein said chlorination is carried out to remove lithium from said residual aluminum to form an aluminum product containing less than about 0.01 wt % lithium.

15. A process as set forth in claim 14 wherein said aluminum product contains less than about 0.001 wt % lithium.

16. A process as set forth in claim 15 comprising oxidizing more than 50 wt % of said lithium out of the aluminum alloy as lithium ions in said lithium transport cell.

17. A process as set forth in claim 16 comprising oxidizing more than 75 wt % of said lithium out of the aluminum alloy in said lithium transport cell.

18. A process as set forth in claim 17 wherein said layered electrolysis in a lithium transport cell comprises passing direct current through a three-layered cell having a layer of aluminum-lithium alloy, oxidizing lithium out of the alloy into a middle layer of a molten salt electrolyte and reducing lithium ions in said molten salt electrolyte to form lithium metal in the opposite end layer of the three-layered cell.

19. A process as set forth in claim 18 wherein said molten salt comprises a lithium chloride-potassium chloride-lithium fluoride salt mixture.

20. A process as set forth in claim 19 wherein said layered electrolysis further comprises removing moisture from the aluminum-lithium alloy scrap prior to feeding said scrap into the lithium transport cell.

21. A process as set forth in claim 20 wherein said layered electrolysis comprises a direct current density controlled to be less than about 4 amps per square inch at the anode surface.

22. A process for purifying aluminum and lithium recovered from aluminum-lithium alloy scrap comprising:

(a) feeding a low moisture molten salt electrolyte of lithium chloride-potassium chloride-lithium fluoride and a molten aluminum-lithium-magnesium-copper alloy to a layered electrolysis cell and passing direct current to said layered electrolysis cell to form a first end layer of molten aluminum-lithium alloy, a middle layer of molten salt electrolyte, and an opposite end layer of molten lithium;

(b) controlling current density such that said first end layer acts as an anode at less than about 4 amps per square inch and to oxidize lithium as lithium ions out of the aluminum alloy and into said middle layer of electrolyte;

(c) reducing lithium ions to lithium metal at a cathode immersed in the molten salt electrolyte;

(d) removing lithium as lithium metal from said opposite end layer in the layered electrolysis cell;

(e) withdrawing residual aluminum alloy from said first end layer after about 80% of the lithium has been oxidized out of the alloy and withdrawn as lithium ions; and (f) purifying said withdrawn residual aluminum alloy through layered electrolysis in a second stage lithium transport cell to form a purified aluminum-copper alloy containing less than about 0.001 wt % lithium.

* * * * *